US005599213A

United States Patent [19]

Frommer et al.

[11] Patent Number: 5,599,213

[45] Date of Patent: Feb. 4, 1997

[54] CONTACT SPRING ARRANGEMENT

[75] Inventors: Jurgen Frommer, Fellbach; Erich Kreutter, Winterbach, both of Germany

[73] Assignee: ITT Cannon Electric GmbH, Weinstadt, Germany

[21] Appl. No.: 370,041

[22] Filed: Jan. 9, 1995

[30] Foreign Application Priority Data

Jan. 11, 1994 [DE] Germany ..... 44 00 499.0

[51] Int. Cl.[6] ..... H01R 15/10

[52] U.S. Cl. ..... 439/857; 439/862

[58] Field of Search ..... 439/856, 857, 439/862, 884, 889, 861, 886

[56] References Cited

U.S. PATENT DOCUMENTS

| | | | |
|---|---|---|---|
| 3,824,554 | 7/1974 | Shoholm | 339/221 |
| 4,002,391 | 1/1977 | Dunn et al. | 339/98 |
| 4,660,922 | 4/1987 | Cooney et al. | 439/889 |
| 4,769,907 | 9/1988 | Sebastien | 28/874 |
| 4,874,338 | 10/1989 | Bakermans | 439/856 |
| 5,106,329 | 4/1992 | Maeshima et al. | 439/856 |
| 5,188,547 | 2/1993 | Dixon et al. | 439/884 |
| 5,224,885 | 7/1993 | Youngfleish | 439/857 |

FOREIGN PATENT DOCUMENTS

| | | | |
|---|---|---|---|
| 0208500 | 1/1986 | European Pat. Off. . | |
| 488487A | 6/1992 | European Pat. Off. | 439/884 |
| 979211 | 4/1962 | United Kingdom . | |

*Primary Examiner*—Neil Abrams
*Assistant Examiner*—Brian J. Biggi
*Attorney, Agent, or Firm*—Thomas L. Peterson

[57] ABSTRACT

The description relates to a contact spring arrangement. The contact springs have contact heads (2) each having a convex contact surface and two side surfaces. According to the invention, recesses (7, 17, 18) are embossed in the surfaces of the contact head, with the result that the contact surfaces (4) are smoothed and made wider.

7 Claims, 3 Drawing Sheets

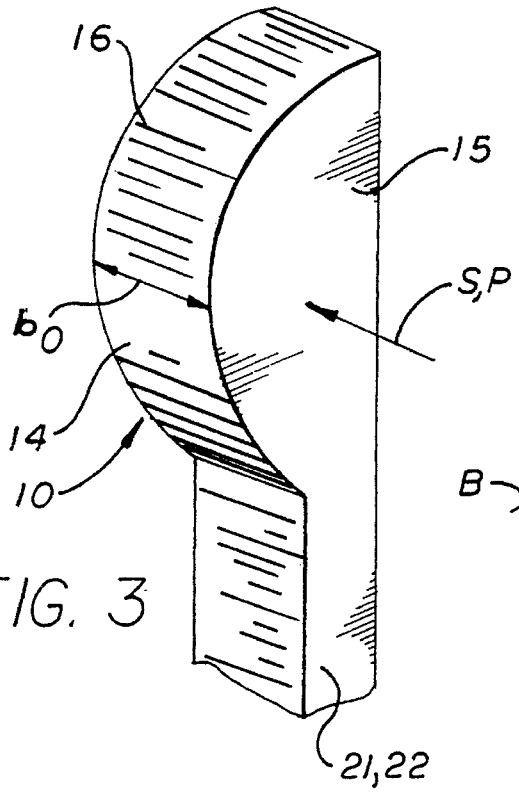
FIG. 3
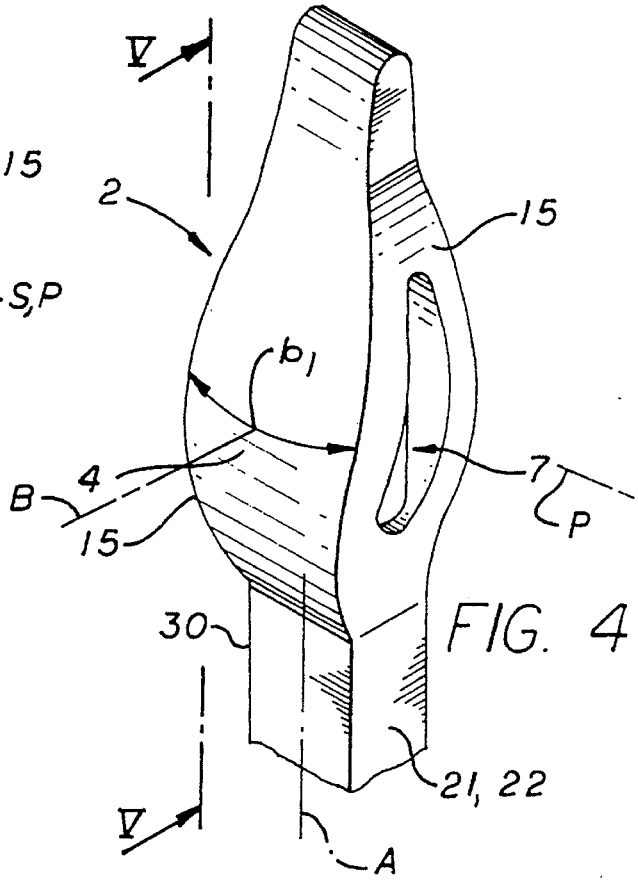
FIG. 4
FIG. 5
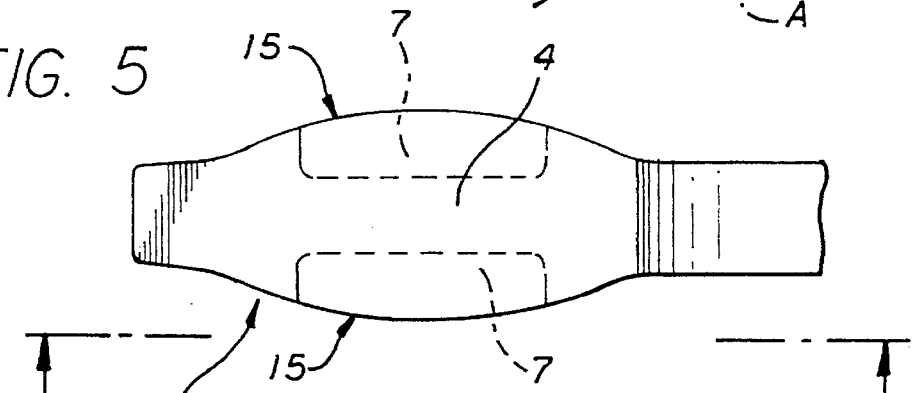
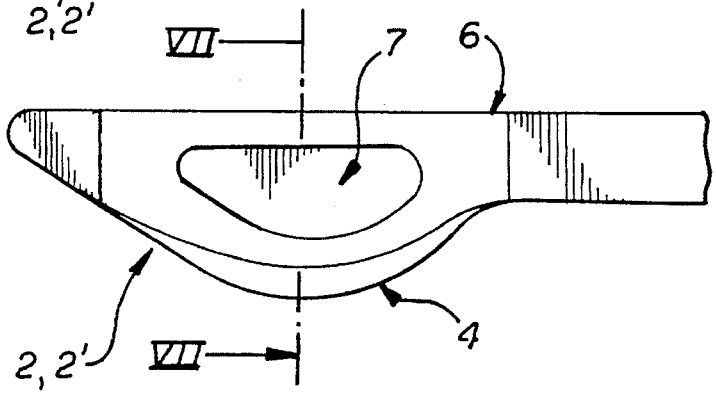
FIG. 6

CONTACT SPRING ARRANGEMENT

DESCRIPTION

The invention relates to a contact spring arrangement comprising two oppositely disposed contact springs each having a contact head comprising a contact surface and two side surfaces, such that the two contact surfaces are opposite one another.

One simple method of manufacturing contact spring arrangements of the aforementioned kind is to punch them out of flat sheet metal. The result, however, is that the contact surface is the surface along which the punching cut is made. This surface, however, is formed with grooves during cutting (see the grooves 16 in FIG. 1). If a plug is inserted between two such contact springs so as to make an electric contact, the grooves gradually act like a file, so that the plug rapidly wears away. Also the resulting electric contact is not efficient. Likewise the width of the contact is limited by the thickness of the material from which the contact spring arrangement was punched out.

U.S. Pat. No. 4,660,922 discloses a press-fit pin having a cylindrical contact region. The head is for anchoring the pin (which is a part of a plug strip) firmly in a receiving part 46 (FIG. 5A). Admittedly this component has a convex surface and side surfaces, but it does not solve the problem of eliminating the grooves in a contact surface formed during punching.

The German Utility Model shows recesses formed by punching, but these are not for improving the contact surface but for anchoring the pin in a retaining plate (see page 5, line 10).

The object of the invention is to devise a contact-spring arrangement of the initially-mentioned kind such that the contact surface is improved.

To this end, according to the invention, at least one recess is embossed in each side surface and the contact surfaces are smoothed and widened by the flow of material occurring during embossing.

When the recess is embossed, the material of the contact surfaces flows in the width direction, provided the mould is suitably shaped. This widens the contact surface and smooths out the grooves resulting from the preceding punching process. A convex surface may also form transversely of the longitudinal direction of the contact springs, so that the total contact surface becomes spoon-shaped. This is a simple method of increasing the contact surface area and improving its quality.

Other advantageous features of the invention are defined in the sub-claims, together with the method of producing the aforementioned, contact springs.

Embodiments of the invention will now be described with reference to the accompanying drawings, in which:

FIG. 3 shows a contact-spring blank after punching;

FIG. 4 shows a contact spring after embossing;

FIG. 5 is a plan view of the contact spring in FIG. 4 in the direction of arrows V—V in FIG. 2;

FIG. 6 is a side view in the direction of arrows VI—VI in FIG. 5;

Figure 1:
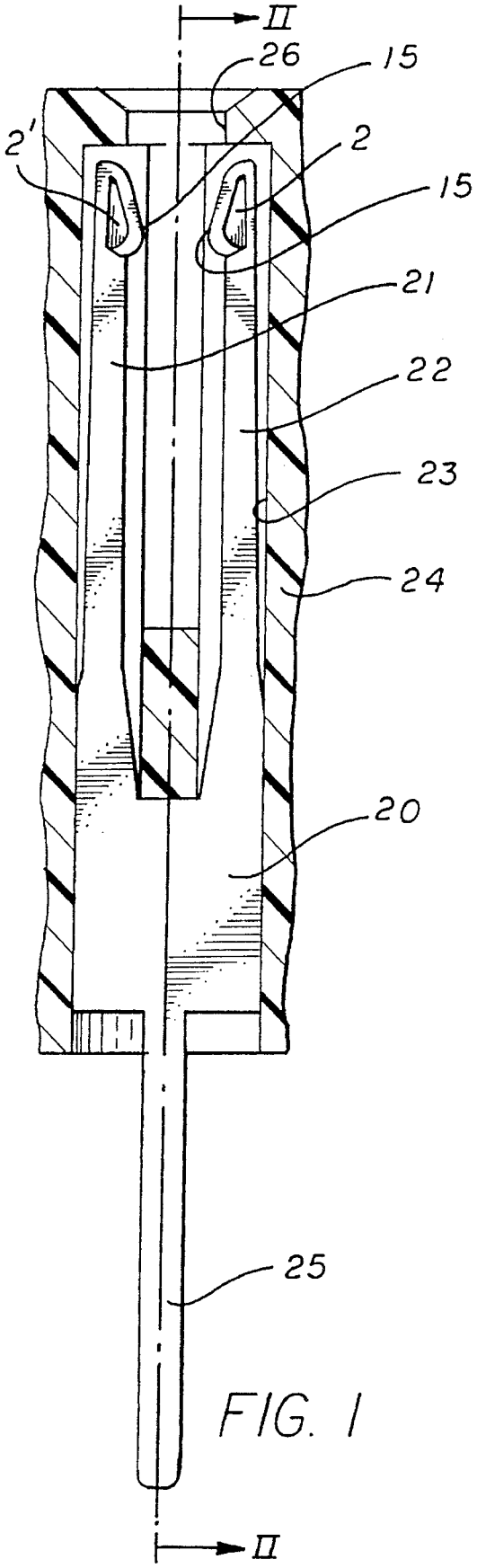
FIG. 1 is a plan view of a first embodiment of a contact spring arrangement in a bore in a printed circuit board.
Figure 2:
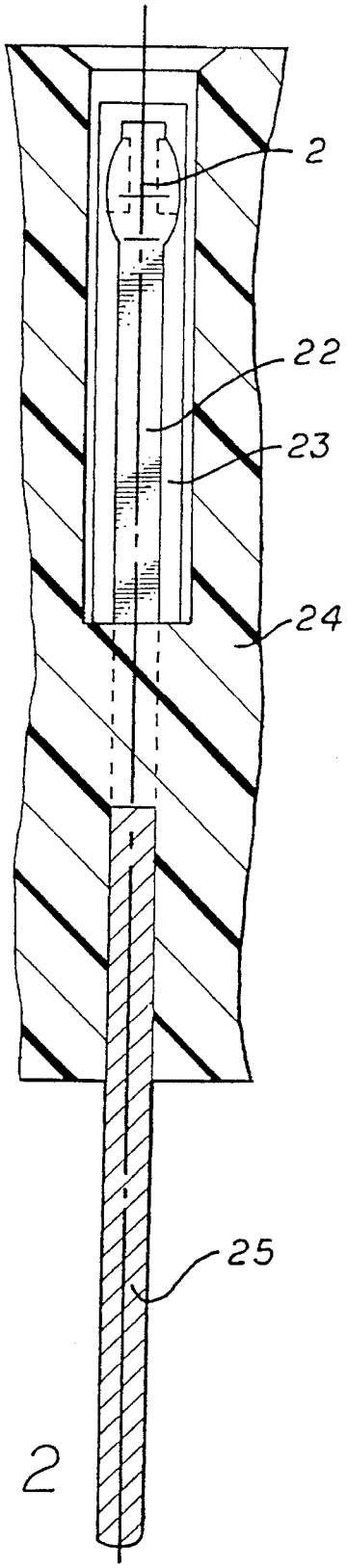
FIG. 2 is a section along line II—II in FIG. 1.

FIG. 1 shows a contact spring arrangement 20 with two contact springs 21 and 22. The arrangement is inserted into a bore 23 in a plastics board 24, (printed circuit board) and a contact pin 25 is disposed in the end projecting beyond the board 24. The pin can be a "press-fit" contact, i.e. a contact comprising a resiliently compressible region (not shown) for holding it in the bore of an additional plastics board (printed circuit board).

A number of such contact springs arrangements are disposed in a number of bores 23, e.g. in an array of 3×32 bores in a plug panel.

Each contact spring 21, 22 has contact heads 2, 2'. In order to make a contact, a pin (not shown) is inserted from above (in FIG. 1) between the two contact heads 2, 2', i.e. through an insertion opening 26.

FIG. 3 shows a contact-spring blank 10 punched out of sheet metal and with side surfaces 15 and a contact surface 14. The width $b_0$ of a contact head 2 is equal to the thickness of the sheet of metal from which the contact springs 21, 22 were punched. The punched blank, as shown in FIG. 3, has grooves 16 formed by cutting during the punching process, which occurs in the relevant prior art. If a plug (not shown) is inserted between the contact surfaces 14 of two opposite contact springs 21, 22, obviously the grooves 16 act substantially like a file on the contact surface of the plug. Also there is no efficient electric contact via the contact surface 14 formed with grooves 16 during the cutting process. Furthermore the width $b_0$ of the contact surface is limited to the thickness of the metal sheet from which the contact spring was punched out.

In the first embodiment of the invention, an aformentioned contact spring is additionally machined by embossing recesses 7 in the direction P in the two side surfaces 15 as shown in FIG. 5. The material displaced by the embossing process causes the contact surface 14 to flow. This smoothes the contact spring in the mould, so that the grooves 16 resulting from the previous punching process largely disappear. The result is the contact surface 4 of the finally-machined contact head 2 or 2'. The contact surface also flows in the width direction, provided of course that the mould is suitably shaped. The contact surface 4 then has a width $b_1$ greater than the original width $b_0$ of the blank 10 before the recesses 7 were formed by embossing. Another result therefore, likewise assuming that the mould is suitably shaped, is a convex shape transversely of the longitudinal direction A of the contact spring (compare FIG. 7). This results in a spoon-shaped contact surface 4, smoothed by the embossing process, and also making an efficient electric contact.

FIG. 4 shows that the contact head 2 lies at the end of an elongated portion 30 which is shown extending parallel to a vertical line A. The contact surface 4 is smoothly convexly curved about at least one axis extending parallel to the vertical line A. The contact surface 4 is also smoothly curved about at least one line extending parallel to directions P, which are perpendicular to line A and to a line B. Line B extends normal to the center of the contact surface 4 and is perpendicular to the lines A, P.

Figure 7:
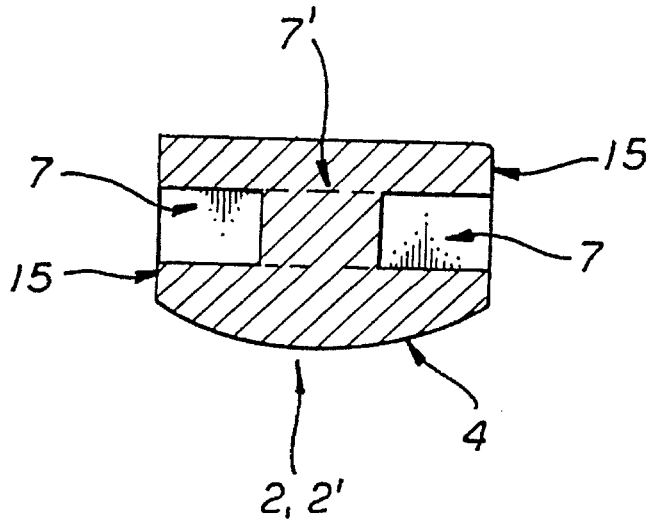
FIG. 7 is a section along line VII—VII in FIG. 6.

In an extreme case the recesses 7 can be embossed so far that they merge into one another, i.e. so that a continuous recess 7' is produced as shown by chain lines in FIG. 7.

Figure 8:
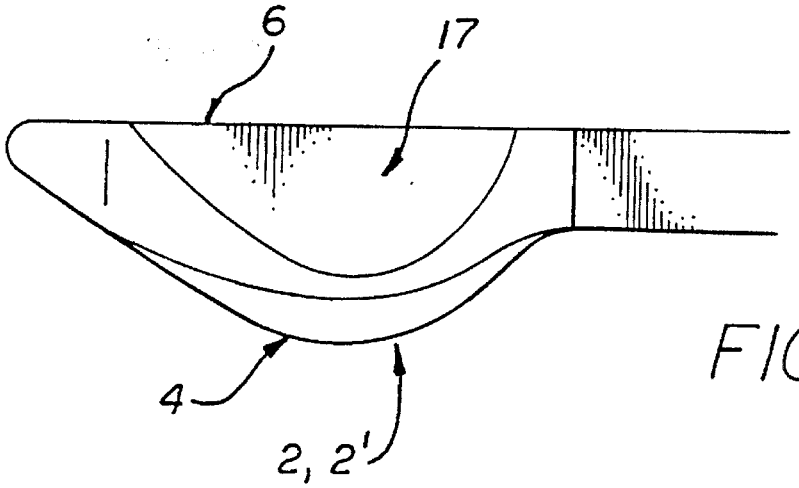
FIG. 8 is a side view, similar to FIG. 6, of a second embodiment.

In the second embodiment in FIG. 8, recesses 17 are embossed and shaped so as to be open towards the surface 6 opposite the contact surface 4.

Figure 9:
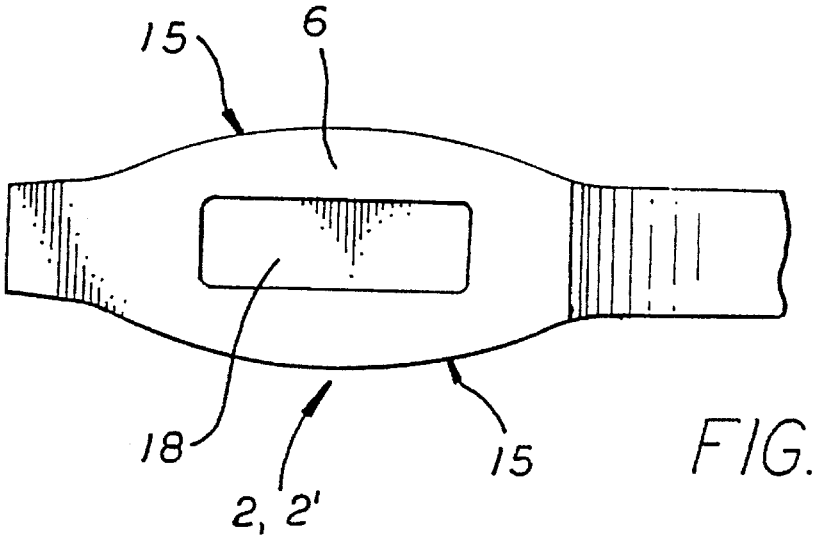
FIG. 9 is a plan view, similar to FIG. 6, of a third embodiment.

In the third embodiment in FIG. 9, only one pocket 18 is embossed, i.e. in the surface 6.

We claim:

1. A contact spring arrangement comprising two oppositely disposed contact springs (21, 22) each having a contact head (2, 2') comprising a contact surface (4) and two side surfaces (15), such that and wherein the two contact surfaces (4) are opposite one another, characterised in that at least one recess (7) is embossed in each side surface (15) and the contact surfaces (4) are smoothed and widened by the flow of material occurring during embossing.

2. A contact spring arrangement according to claim 1, characterised in that the contact surface (4) is also given a convex shape transversely of the longitudinal direction (a).

3. A contact spring arrangement according to claim 1, characterised in that the recesses (7), starting from the two side surfaces (15), merge into one another and extend through the cross-section of the contact head (2).

4. A contact spring arrangement according to claim 1, characterised in that the contact head is made spoon-shaped by embossing.

5. A contact that has been punched from sheet metal and that has a contact head (2, 2') with a contact surface (4) for engaging a mating contact and two opposite side surfaces (15), wherein:

at least one recess is embossed in each side surface, with the contact surface being smoothed and widened by the flow of material occurring during embossing.

6. The contact described in claim 5 wherein:

said contact has a vertically elongated portion (30) lying below said head;

said contact surface is given a convex shape in a horizontal direction by the flow of material during embossing, so the contact surface is smoothly convexly curved about at least one vertical axis.

7. A contact that has been punched from sheet metal and that has a contact head with a contact surface (4) for engaging a mating contact and an opposite surface (6) wherein:

said opposite surface (6) is embossed, and the contact surface is smoothed and widened by the flow of material occurring during embossing, with said contact surface being formed to a smoothly curved convex spoon shape by said embossing so said contact surface is smoothly curved about two axes (A, P).

* * * * *